US011187453B2

(12) United States Patent
Yeom

(10) Patent No.: US 11,187,453 B2
(45) Date of Patent: Nov. 30, 2021

(54) REFRIGERATOR

(71) Applicant: LG Electronics Inc., Seoul (KR)

(72) Inventor: Tae Jin Yeom, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/010,374

(22) Filed: Sep. 2, 2020

(65) Prior Publication Data

US 2021/0063079 A1 Mar. 4, 2021

(30) Foreign Application Priority Data

Sep. 3, 2019 (KR) ..... 10-2019-0108968

(51) Int. Cl.
*F25D 25/02* (2006.01)
*F25D 23/02* (2006.01)

(52) U.S. Cl.
CPC ..... *F25D 25/022* (2013.01); *F25D 23/025* (2013.01); *F25D 2325/021* (2013.01)

(58) Field of Classification Search
CPC .... F25D 25/022; F25D 23/04; F25D 2400/18; F25D 25/04; F25D 23/025; F25D 2323/023; F25D 25/025; F25D 23/067; F25D 2325/021; F25D 25/024; A47B 57/32; A47B 88/437; A47B 2210/175
See application file for complete search history.

(56) References Cited

U.S. PATENT DOCUMENTS 3,099,501 A * 7/1963 Hillson ..... A47B 88/487 384/19
3,234,897 A * 2/1966 Berk ..... A47B 57/42 108/152
5,199,778 A * 4/1993 Aoki ..... A47B 57/32 312/408
9,033,437 B2 * 5/2015 Klitzing ..... A47B 88/437 312/404
9,429,355 B2 * 8/2016 Seo ..... F25D 23/04
10,330,371 B2 * 6/2019 Jung ..... F25D 23/04
10,610,016 B2 * 4/2020 Nilsson ..... A47B 57/42
2010/0175414 A1 * 7/2010 Kim ..... F25D 23/04 62/377
2010/0176702 A1 * 7/2010 Kim ..... F25D 23/04 312/405.1
2012/0018435 A1 * 1/2012 Kim ..... F25D 23/04 220/592.02
2013/0119845 A1 * 5/2013 Seo ..... F25D 23/025 312/404

(Continued)

*Primary Examiner* — Hiwot E Tefera
(74) *Attorney, Agent, or Firm* — Fish & Richardson P.C.

(57) ABSTRACT

A refrigerator has a moving basket. The refrigerator includes a door, a rail member, and a roller member. The door opens and closes a cabinet and has a separate storage room. The rail member is received in a rail receiving part provided at each of left and right opposite sides of the storage room and has a space therein. The roller member is coupled to the rail member so that the basket lifts and lowers along the rail member in the storage room. The insertion hole is defined by being open at the left and right opposite sides of the storage room corresponding to the rail receiving part. The insertion hole defines the trajectory of the lifting and lowering of the basket. The cover member is provided inside the rail receiving part and covers the insertion hole by being lifted and lowered during the lifting and lowering of the basket.

19 Claims, 16 Drawing Sheets

(56) References Cited

U.S. PATENT DOCUMENTS

| | | | | |
|---|---|---|---|---|
| 2017/0191740 | A1* | 7/2017 | Jung | F25D 23/025 |
| 2017/0191741 | A1* | 7/2017 | Jung | F25D 25/022 |
| 2017/0284729 | A1* | 10/2017 | Lim | F25D 23/04 |
| 2017/0328627 | A1* | 11/2017 | Park | F25D 11/02 |
| 2018/0372394 | A1* | 12/2018 | Kim | F25D 11/00 |
| 2019/0219324 | A1* | 7/2019 | Kang | F25D 25/022 |

* cited by examiner

REFRIGERATOR

CROSS REFERENCE TO RELATED APPLICATION

The present application claims priority to Korean Patent Application No. 10-2019-0108968, filed on Sep. 3, 2019, the disclosure of which is incorporated herein by reference in its entirety.

TECHNICAL FIELD

The present disclosure relates to a refrigerator having a moving basket.

BACKGROUND

A refrigerator stores food at a low temperature in an internal storage space and maintains the stored food in an optimal state by cooling the storage space with cold air. The cold air can be generated through heat exchange with a refrigerant that circulates in a refrigeration cycle.

Refrigerators become larger and multifunctional as eating habits and user preferences are diversified. Refrigerators having various structures and convenience devices have been released for user convenience and freshness of stored food products.

A main door of a refrigerator can be equipped with a home-bar, an ice maker, a shelf, or a basket, etc. at a rear surface of the main door, and thus the rear surface of the main door can be more frequently used as a separate auxiliary space. That is, a main door can be used not only to open and close a freezer compartment or a refrigerating compartment, but to provide a separate storage room or perform additional functions such as the production and supply of ice or mineral water.

In addition, a separate auxiliary door may be provided on a front surface of the main door of the refrigerator, so that the separate storage room can be approached by opening the auxiliary door without opening the main door of the refrigerator.

Furthermore, the separate storage room defined at the main door may be provided with one or more baskets for storing food. A user can approach the baskets from the front of the main door by opening the auxiliary door. Alternatively, the separate storage room may be approached from the rear of the main door when the main door is opened.

Accordingly, frequently used food may be stored in the basket provided at the main door of the refrigerator, so that a user can easily approach the food stored in the basket by opening the auxiliary door as well as by opening the main door.

In order to mount the basket to the main door, a coupling structure may be provided between the main door and the basket to couple the basket to the main door. The basket may be coupled to the main door so as to be vertically movable.

Some refrigerators may include a moving basket that is vertically movable at a main door. For example, a cut-shaped rail mounting part can be provided at a door dike of the main door. Furthermore, a side of the moving basket can be inserted to the rail mounting part, and the moving basket can be coupled to a rail provided at the rail mounting part such that the moving basket is vertically movable therein. To achieve this, the rail mounting part may have a cut shape and be vertically long such that the moving basket can be vertically moved while a side thereof is inserted to the door. For example, the rail mounting part having the cut shape may be defined in the door and define a trajectory of the vertical movement of the moving basket. Further, the rail mounting part that defines the trajectory of the vertical movement of the moving basket may be exposed to the outside, which ruin the appearance of the refrigerator. Furthermore, foreign matter may be introduced into the rail mounting part, thereby affecting cleanliness. Additionally, the vertical movement of the moving basket may cause safety issues. For example, a portion of a user's body may be caught and injured by the rail mounting part during the vertical movement of the moving basket.

SUMMARY

To address the above and other problems, implementations of the present disclosure provides a refrigerator that covers a trajectory of movement of a moving basket that is mounted to a door and vertically movable.

Implementations of the present disclosure provides a refrigerator that increases strength of the roller that is coupled to a moving basket and lifted and lowered.

Implementations of the present disclosure provides a refrigerator that reduces noise that occurs during the lifting and lowering of the moving basket.

Implementations of the present disclosure provides a refrigerator that securely fixes a cover member to the basket by a fastening means such as a screw. The cover member covers an insertion hole that receives a portion of the moving basket. The fixing may reduce vibration of the cover member and increase coupling force of the cover member to the basket.

Particular implementations of the present disclosure provide a refrigerator that includes a cabinet, a door, a first rail receiving part, a first rail member, a basket, a first roller member, a first insertion hole, and a first cover member. The door is configured to open and close at least a portion of the cabinet and that includes a storage room. The first rail receiving part is disposed at a first side of the storage room and that defines a first rail space. The first rail member is received in the first rail space of the first rail receiving part. The basket is disposed in the storage room of the door. The first roller member is disposed at a first side of the basket and is coupled to the first rail member so that the basket moves along the first rail member. The first insertion hole is open at the first side of the storage room to correspond to the first rail receiving part and defines a path of the movement of the basket. The first cover member is disposed in the first rail receiving part and is configured to, based on the movement of the basket, move to cover the first insertion hole. The first roller member mounts the first cover member to the basket.

In some implementations, the refrigerator can optionally include one or more of the following features. The first rail member may include a first movement space that permits the first roller member to move, and a first basket guide part that guides the movement of the first roller member. The first basket guide part may cover the first roller member. The first roller member that is inserted into the first movement space may be configured to move along the first basket guide part. The basket may include a basket body configured to receive an item, and a moving frame that is mounted to the basket body. The first roller member may be disposed at a first side of the moving frame. The first roller member may include a roller configured to move along the first basket guide part in the first movement space, and a rotation center fastening shaft that fastens the roller to the basket. The roller may be configured to move along the first basket guide part and rotate relative to the rotation center fastening shaft. The first cover member may define a hole at a position that corresponds to a position of the roller. The rotation center fastening shaft may be inserted into a center of the roller, extend through the hole of the first cover member, and be fastened to the basket. A diameter of the hole may be smaller than a diameter of the rotation center fastening shaft. The first cover member may have a width equal to or greater than a width of the first insertion hole. The first cover member has a length that is equal to or greater than a sum of a maximum movement length of the basket and a length of the insertion hole, so that the insertion hole is covered by the basket that maximally moves. Based on the basket being maximally moved in a first direction, a first end of the first cover member may be located at a position lower than a first end of the insertion hole by at least the maximum movement length of the basket. Based on the basket being maximally moved in a second direction opposite to the first direction, a second end of the first cover member is located at a position higher than a second end of the insertion hole by at least the maximum movement length of the basket. The second end of the first cover member being opposite to the first end of the first cover member, and the second end of the insertion hole being opposite to the first end of the insertion hole. The first rail member and the first cover member may be spaced apart by a predetermined distance from each other to restrict the first cover member from interfering with the first rail member during the movement of the first cover member. At least one of opposite ends of the first cover member may include a plurality of angled portions. The door may include a main door and a sub door. The main door may be coupled rotatably to the cabinet, and be configured to, based on the rotation of the main door, open and close the cabinet. The main door may include an open part that is open to a storage space of the cabinet. The sub door may be mounted rotatably to the main door, and be configured to open and close the open part of the main door. The open part of the sub door may define the storage room of the door. The refrigerator may extend along a longitudinal direction, and the basket may be configured to move along the longitudinal direction. The refrigerator may further include a second rail receiving part, a second rail member, a second roller member, a second insertion hole, and a second cover member. The second rail receiving part may be disposed at a second side of the storage room and define a second rail space. The second rail member may be received in the second rail space of the second rail receiving part. The second roller member may be disposed at a second side of the basket and be coupled to the second rail member so that the basket moves along the second rail member. The second insertion hole may be open at the second side of the storage room to correspond to the second rail receiving part and define a path of the movement of the basket. The second cover member may be disposed in the second rail receiving part and be configured to, based on the movement of the basket, move to cover the second insertion hole. The second roller member mounts the second cover member to the basket. The second side of the storage room may be opposite to the first side of the storage room, and the second side of the basket may be opposite to the first side of the basket. The second rail member may include a second movement space that permits the second roller member to move, and a second basket guide part that is configured to guide the movement of the second roller member. The second basket guide part may cover the second roller member. The second roller member that is inserted into the second movement space may be configured to move along the second basket guide part. The second roller member may be disposed at a second side of the moving frame that is opposite to the first side of the moving frame. The second roller member may include a roller configured to move along the second basket guide part in the second movement space, and a rotation center fastening shaft that fastens the roller to the basket. The roller may be configured to move along the second basket guide part and rotate relative to the rotation center fastening shaft.

In order to achieve the above and other objectives, some implementations of a refrigerator including: a door that opens and closes a storage space of a cabinet and that has a separate storage room therein; a rail member that is received in a rail receiving part provided at each of left and right opposite sides of the storage room and that has a space therein; and a roller member that is coupled to the rail member so that the basket lifts and lowers along the rail member provided in the storage room.

Accordingly, the roller member may rotate along the rail member in a space defined therein so that the basket is vertically moved.

In some implementations, the insertion hole may be open at the left and right opposite sides of the storage room that corresponds to the rail receiving part, and may define a trajectory of the lifting and lowering of the basket. The cover member may be provided inside the rail receiving part and cover the insertion hole by being lifted and lowered during the lifting and lowering of the basket.

In some implementations, the cover member may be fixed to the basket by the roller member.

In some implementations, the rail member may include a first lifting/lowering space in which the roller member is lifting and lowering, and guide the vertical movement of the roller member.

In some implementations, a basket guide part may have a shape that covers the left and right of the roller member so that the roller member that is inserted into the first lifting/lowering space may move vertically along the basket guide part, so that the roller member can be stably moved and be prevented from being removed from the rail member.

In some implementations, the basket may include a basket body that has a receiving space for food, and a moving frame to which the basket body is mounted. The roller member is provided at left and right opposite sides of the moving frame.

In some implementations, the roller member may include a roller that is movable along the basket guide part in the first lifting/lowering space, and a rotation center fastening shaft that fastens the roller to the side surface of the basket. The roller may be moved along the basket guide part while being rotated relative to the rotation center fastening shaft.

In some implementations, the cover member may have a hole at a position corresponding to the roller. The rotation center fastening shaft that is inserted to the center of the roller may pass through the hole of the cover member and may be fastened to the basket.

In some implementations, a diameter of the hole may be configured to be smaller than a diameter of the rotation center fastening shaft.

In some implementations, the cover member may have the same width as or a width larger than the left and right width of the insertion hole.

In some implementations, the cover member may have at least a length that is a sum of the maximum liftable/lowerable length of the basket and the vertical length of the insertion hole, to cover the insertion hole when the basket is maximally lifted or lowered.

In some implementations, when the basket is maximally lowered, the lower end of the cover member is located at a position that is lower than the lower end of the insertion hole by at least the maximum liftable/lowerable length of the basket. When the basket is maximally lifted, the upper end of the cover member is located at a position that is higher than an upper end of the insertion hole by at least the maximum lowerable length of the basket.

In some implementations, the rail member may be spaced apart by a predetermined distance from the cover member such the cover member does not collide with the rail member during the lifting and lowering of the cover member. At least one end of the left and right opposite ends of the cover member may be formed by being bent multiple times.

In some implementations, the door may be rotatably coupled to the cabinet, and may open/close the storage space based on the rotation thereof. The door may include a main door that defines an open part that communicates with the storage space. The door may include a sub door that is rotatably coupled to the main door, and that can open and close the open part. The storage room may be defined by the open part.

The refrigerator according to implementations of the present disclosure may provide the following advantages.

First, the basket is provided in the storage room that is defined at the door and that can be lifted and lowered, and the rail member to which the roller member of the basket is coupled is received in the rail receiving part that is provided inside the door.

Therefore, the rail member is not exposed to the outside, which provides a neat appearance of a refrigerator.

In this case, the insertion hole that defines the trajectory of the vertical movement of the basket may be provided at the left and right opposite sides of the storage room. The cover member can cover the insertion hole while being lifted and lowered during the lifting and lowering of the basket.

Accordingly, the trajectory of the vertical movement of the basket is covered, thereby providing neater appearance of a refrigerator, reducing introduction of foreign matter through the insertion hole, and preventing a portion of a user's body from being caught in the insertion hole.

Second, the cover member is configured to have at least the length that sums the maximum liftable/lowerable length of the basket and the vertical length of the insertion hole, thereby covering the insertion hole even when the basket is maximally lifted or lowered.

Third, the basket guide part is provided at the rail member and has the first lifting/lowering space guiding the lifting/lowering of a lifting device. Accordingly, a separate component for guiding the lifting/lowering of the cover member may not be required, thereby making the configuration of a refrigerator simple, and reducing manufacturing cost thereof.

Fourth, the rail member is spaced apart by at least a predetermined distance from the cover member. Thus the cover member does not hit or collide with the rail member during the lifting and lowering of the cover member, thereby reducing noise that may result from the collision or friction therebetween. Further, the roller member is coupled to the rail member so that the roller member is lifted or lowered therein, thereby efficiently lifting and lowering the roller member.

Fifth, when the roller member is coupled to a side surface of the basket, the cover member between the roller member and the side surface of the basket is fixed to the basket by the roller member. Thus the cover member can be securely fixed thereto, and the vibration or shaking thereof can be reduced during the movement thereof. Furthermore, a configuration that installs the cover member becomes simple, and the cover member is configured to be lifted and lowered together with the basket, thereby reducing the manufacturing cost of a refrigerator.

Sixth, at least one end of the left and right opposite ends of the cover member is formed by being bent multiple times. Accordingly, the cover member can be reinforced and the deformation thereof can be prevented. Therefore, the cover member is less vulnerable to damage and can stably cover the insertion hole.

Seventh, the rotation center fastening shaft passes through the center of the roller, and fastens the roller directly to the basket, thereby reinforcing the roller fastened to the basket, and stably lifting and lowering the basket.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
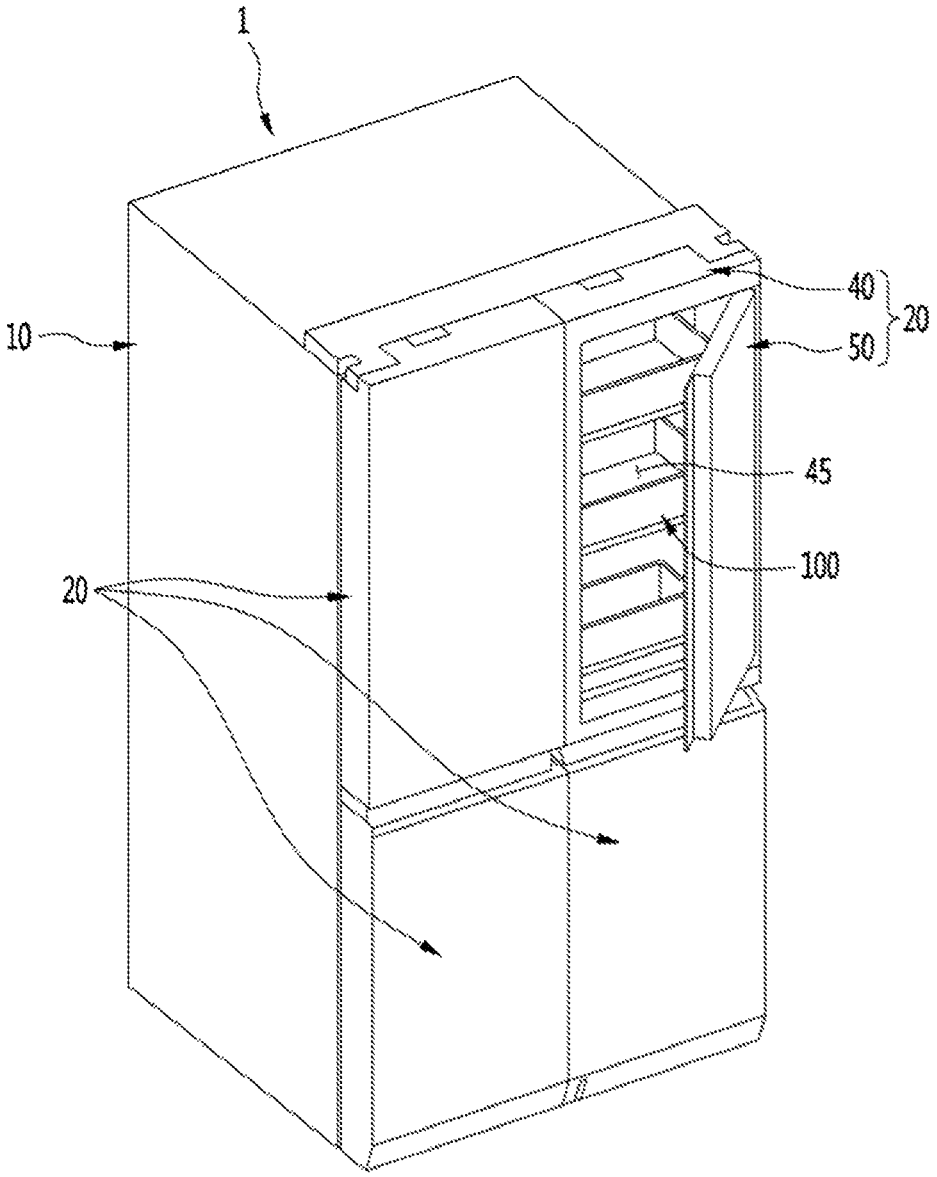
FIG. 1 is a perspective view of an example refrigerator with a sub door being open.

The advantages and features of the present disclosure are described below in detail together with the accompanying drawings. The present disclosure is not limited to implementations disclosed below, but may be implemented in various forms. The same reference numerals refer to the same components throughout the specification.

Hereinafter, specific implementations of the present disclosure will be described in detail with reference to the drawings. The present disclosure is limited to these implementations, and other implementations may fall within the scope of the present disclosure by adding, changing, or deleting other components.

Referring to FIGS. 1-4, an example refrigerator 1 may include a cabinet 10 having a storage space, and have an appearance constituted by the door 20 that can open and close the storage space.

The storage space may be partitioned to multiple storage rooms. For example, the storage space may be divided up and down by a barrier, and may be divided left and right by a barrier.

The multiple storage rooms may include a refrigerating compartment for refrigerating food and a freezer compartment for freezing food.

Various storage members such as shelves and drawers may be provided inside the storage rooms to separately store food.

The door 20 may be hinged to the cabinet 10, and may be provided to open and close the storage rooms by being rotated. Alternatively, the door 20 may be provided to open and close the storage rooms by sliding in and out of the cabinet 10.

In some implementations, the door 20 may be provided as multiple doors. For example, a pair of doors 20 may be provided to open and close one storage room together. In another example, one door 20 may be provided to open and close one storage room.

When the pair of doors 20 is provided to open and close one storage room together, the pair of doors 20 may be arranged left and right. For example, a left door of the pair of doors 20 may open the left of the storage room, and a right door thereof may open the right of the storage room.

In some implementations, at least one door of the multiple doors 20 may be configured to be opened and closed doubly. Hereinafter, the door 20 that can open and close doubly will be described in detail.

In some implementations, the door 20 may include the main door 40 opening and closing the storage room, and the sub door 50 provided rotatably in the main door 40 and opening and closing an open part 45 formed in the main door 40.

The main door 40 may be rotatably mounted to the cabinet 10 by a hinge device. In some implementations, the open part 45 may be provided in the main door 40 and may be open to a predetermined size.

The open part 45 may be provided through the main door 40. For example, the open part 45 may be open toward the front surface of the main door 40, and may also be open toward the rear surface of the main door 40. In the main door 40, the storage room and a separate storage room may be defined by the open part 45.

The front of the open part 45 may be opened and closed by the sub door 50.

The open part 45 may be configured to have a size to occupy most of the front surface of the main door 40 except for some portions of the edges of the main door 40.

The sub door 50 may be rotatably provided by being hinged to the main door 40. Furthermore, the front of the open part 45 can be opened and closed by the rotation of the sub door 50.

At least a portion of the sub door 50 may include a transparent material such as glass. Accordingly, approaching the open part 45 is performed by the opening of the sub door 50, and even when the sub door 50 is closed, the inside of the open part 45 can be seen. Accordingly, the sub door 50 may be called a see-through door.

A storage member may be provided in the open part 45 to store food. For example, the storage member may be provided in the separate storage room that is provided at the main door 40 so as to store food.

One storage member may be provided in the open part 45. Alternatively, multiple storage members may be provided in the open part 45 by being vertically spaced apart from each other.

The main door 40 may include the outer door 41 that constitutes the front surface thereof, and the door liner 42 that constitutes the rear surface thereof.

An insulating space may be defined between the outer door 41 and the door liner 42 and may include an insulating material.

The entire appearance of the main door 40 may be constituted by the coupling of the outer door 41 and the door liner 42 to each other.

Figure 2:
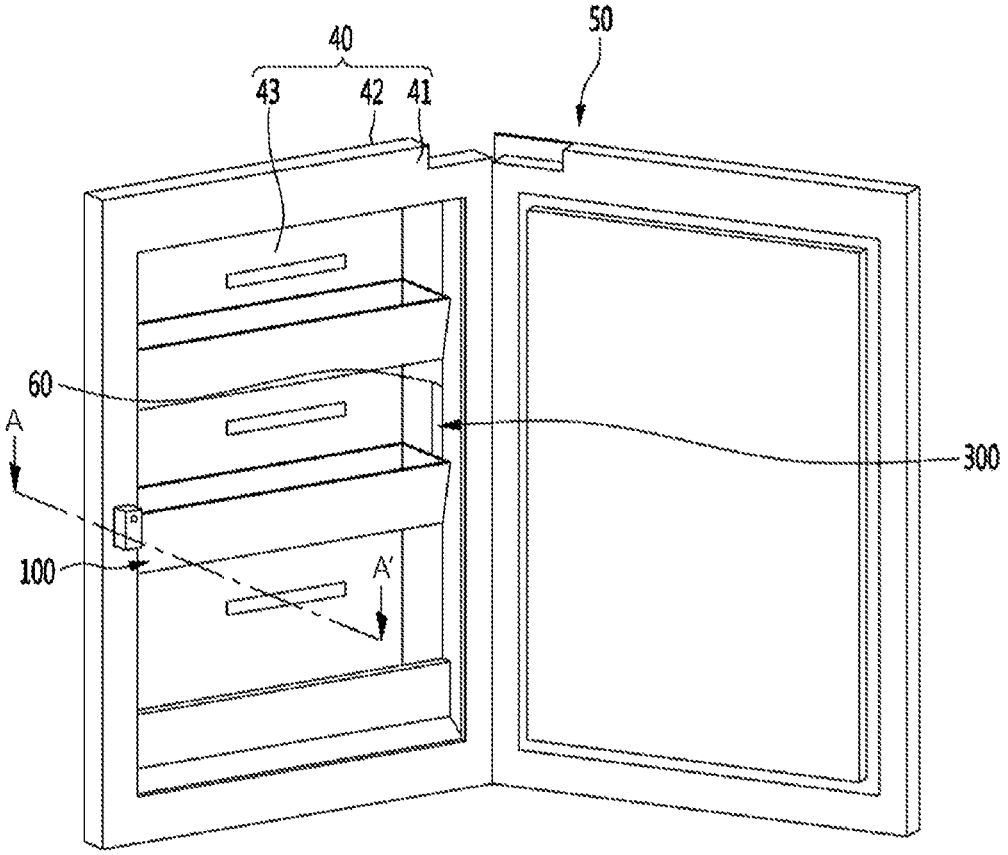
FIG. 2 is a perspective view of an example main door with the sub door being open.
Figure 3:
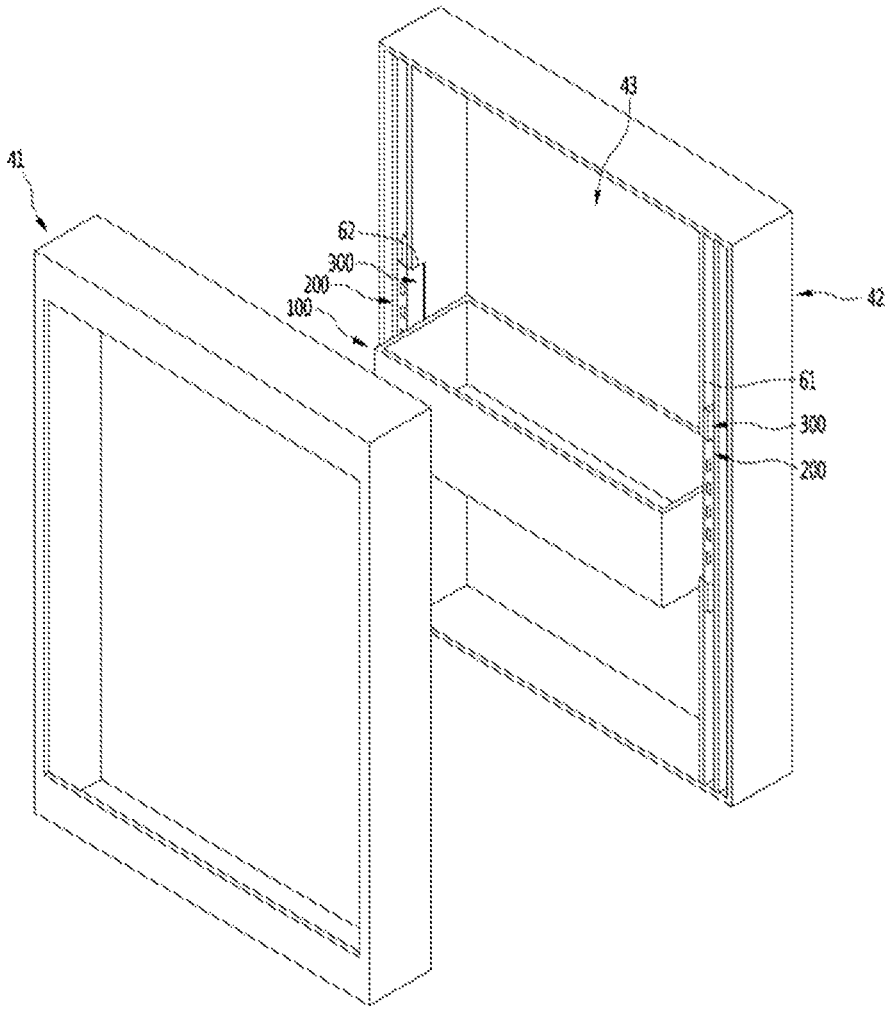
FIG. 3 illustrates that an example outer door and an example door liner of the main door are separated from each other.
Figure 4:
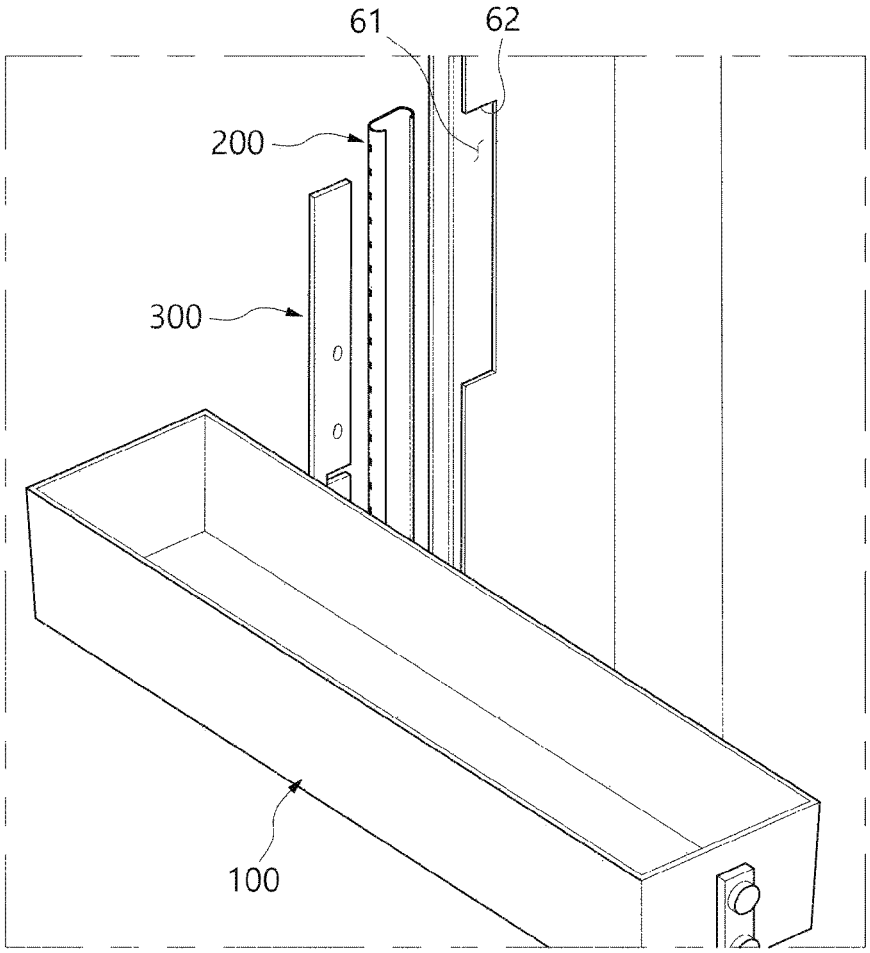
FIG. 4 illustrates that a moving basket, a rail member, and the cover member are separated from the main door.

As shown in FIG. 2, the outer door 41 and the door liner 42 may define the open part 45 when they are partially open. Specifically, inner areas excluding edges of the outer door 41 and the door liner 42 may be defined as the open part 45.

In some implementations, the main door 40 may further include a cover plate 43 covering the rear opening of the open part 45. The cover plate 43 may be coupled to the door liner 42, and may be provided as a plate shape corresponding to the shape of the open part 45.

The cover plate 43 may include a portion that is partially cut such that cold air can flow between the storage space of the cabinet 10 and the open part 45. For example, the cover plate 43 may include a cold-air-flow opening to permit cold air to flow therethrough.

In some implementations, the cover plate 43 may be removed to approach the open part 45 through the rear surface of the main door 40 when the main door 40 is open.

In some implementations, the storage member provided in the open part 45 may be provided to be vertically movable therein. When multiple storage members are provided, all of the multiple storage members may be provided to be vertically movable. Alternatively, only some of the multiple storage members may be provided to be vertically movable.

Hereinafter, as an example of the storage member, a moving basket 100 will be described which is vertically movable in the open part 45.

The moving basket 100 may be provided in the shape of a box open upward to store food. The moving basket 100 may be mounted to the left and right opposite sides of the open part 45 to be vertically movable.

A mounting part 60 may be provided at the left and right opposite sides of the open part 45 to mount the moving basket 100 thereto.

The rail member 200 may be mounted to the mounting part 60 such that the moving basket 100 can be vertically moved. The rail member 200 may vertically extend such that a portion of the moving basket 100 can be inserted into the rail member and the vertical movement of the moving basket 100 can be guided.

In some implementations, the rail member 200 may be received inside the main door 40 so as not to be exposed to the outside.

For example, the mounting part 60 may include a rail receiving part 61 having a space to receive the rail member 200.

The rail receiving part 61 may have a predetermined space at each of the left and right opposite sides of the open part 45 to receive the rail member 200 therein. For example, the space of the rail receiving part 61 may be defined to be vertically long such that the rail member 200 is received therein.

In some implementations, the rail receiving part 61 may be open toward the open part 45 such that a portion of the moving basket 100 can be inserted to the rail member 200.

For example, an insertion hole 62 to which a portion of the moving basket 100 is inserted may be defined at the left and right opposite sides of the open part 45.

The insertion hole 62 may be vertically long at a position corresponding to the position of the rail member 200 received in the rail receiving part 61. Accordingly, a portion of the moving basket 100 extends through the insertion hole 62 to the inside of the rail receiving part 61, and may be mounted to the rail member 200.

In this case, the insertion hole 62 may define the trajectory of the vertical movement of the moving basket 100.

The rail receiving part 61 may be defined by coupling the outer door 41 with the door liner 42. For example, the rail receiving part 61 may be defined between the outer door 41 and the door liner 42.

For example, a part constituting the front portion of the rail receiving part 61 may be defined on the rear surface of the outer door 41, and a part constituting the rear portion of the rail receiving part 61 may be defined on the front surface of the door liner 42.

The rail member 200 may be mounted at a position of the rail receiving part 61 that is provided when the outer door 41 and the door liner 42 are separated from each other. The rail member 200 may be received in the rail receiving part 61 when the outer door 41 and the door liner 42 are coupled to each other.

In some implementations, although the rail member 200 is received in the rail receiving part 61, a portion of the rail member 200 may be exposed to the outside by the insertion hole 62 defining the trajectory of the vertical movement of the moving basket 100. Therefore, the exposure of the insertion hole 62 to the outside may ruin the appearance of the refrigerator.

To prevent this, the cover member 300 may be provided in the mounting part 60, and cover the insertion hole 62 such that the insertion hole 62 is not exposed to the outside.

The cover member 300 may be vertically movable inside the rail receiving part 61. Furthermore, the cover member 300 may cover the insertion hole 62 by being lifted and lowered during the lifting and lowering of the moving basket 100.

The cover member 300 may have a transverse width equal to or greater than the transverse width of the insertion hole 62 so as to cover the insertion hole 62. Additionally, the cover member 300 may be vertically longer than the vertical length of the insertion hole 62 so as to cover the insertion hole 62 during the vertical movement thereof.

Figure 5:
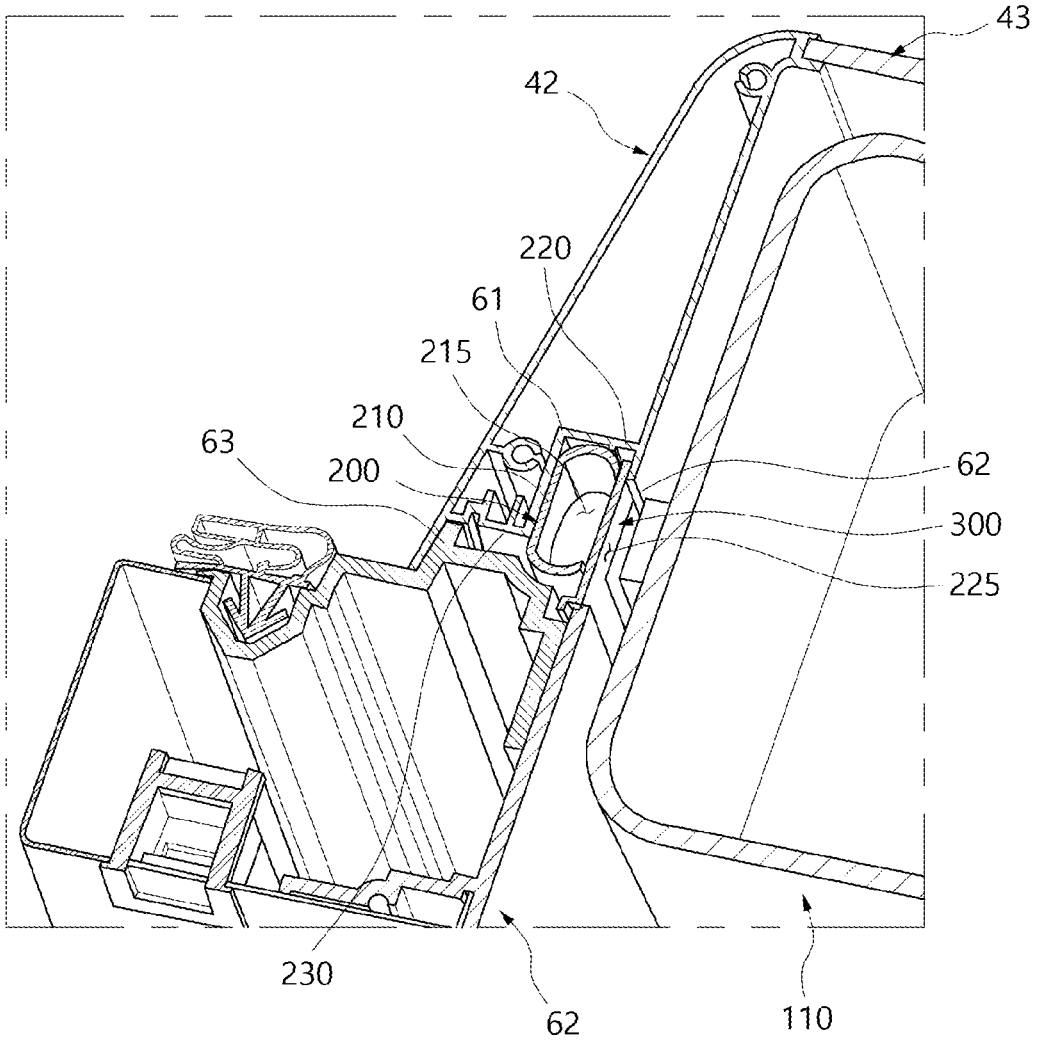
FIG. 5 is a cut-away perspective view of an example structure that couples a mounting part with the moving basket, taken along line A-A' of FIG. 2.
Figure 6:
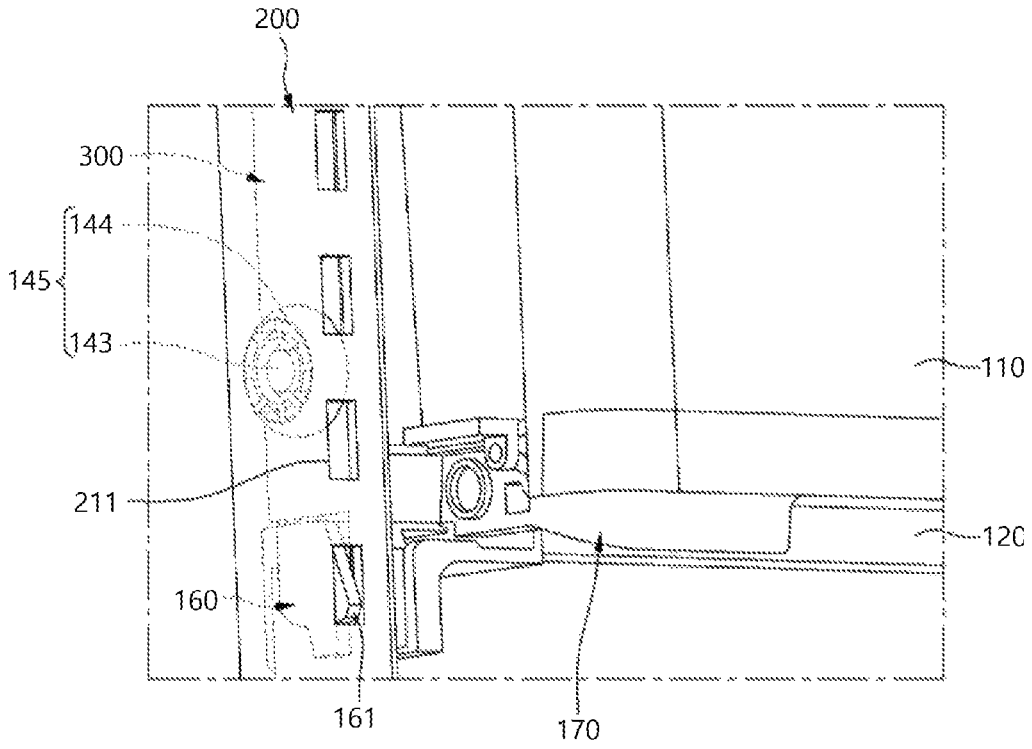
FIG. 6 illustrates an example structure that couples the moving basket with the rail member.
Figure 7:
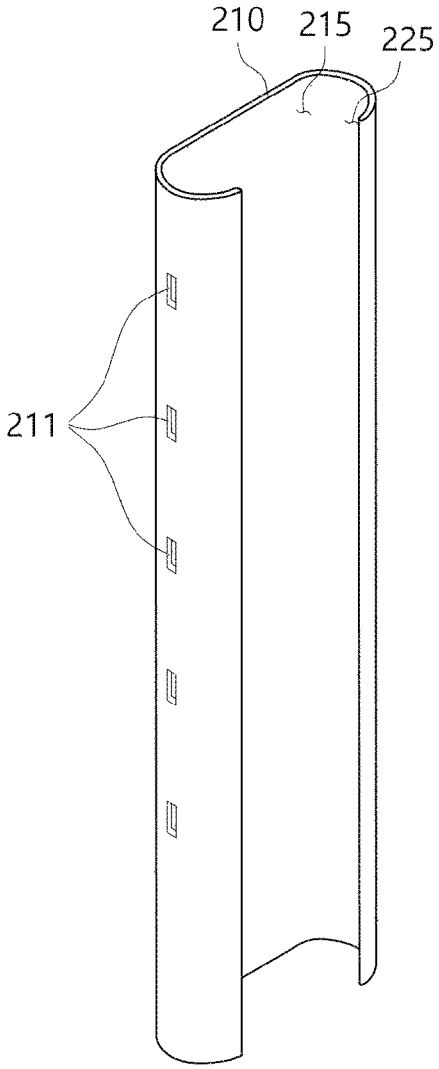
FIG. 7 is a perspective view of the rail member.

Referring to FIGS. 5-7, the cover member 300 may be mounted to the rail member 200 such that the cover member 300 is vertically movable.

The rail member 200 may include a basket guide part 210 configured to guide the lifting and lowering of the moving basket 100. The rail member 200 may include a metal material for high strength.

The roller 144 of the moving basket 100 (described in more detail below) is received in the basket guide part 210, and can be guided to be vertically moved. To this end, the roller 144 is received in the basket guide part 210, and a first lifting/lowering space 215 in which the roller 144 vertically moves may be defined in the basket guide part 210. The roller 144 may be coupled to the moving basket 100.

The basket guide part 210 may be configured to cover the roller 144, and may extend to be vertically long so as to guide the vertical movement of the roller 144. For example, the basket guide part 210 may have a shape that covers the left and right of the roller member 145 so that a roller member 145 inserted into the first lifting/lowering space 215 lifts and lowers along the basket guide part 210.

As such, the basket guide part 210 is configured in the shape of covering the roller member 145, so the roller member 145 can be prevented from being removed from the basket guide part 210 during the vertical movement thereof.

Meanwhile, the first lifting/lowering space 215 may be open toward a side at which the insertion hole 62 is provided. Accordingly, a side of the moving basket 100, which is connected to the roller 144, may be connected to the roller 144 through the insertion hole 62.

Meanwhile, the basket guide part 210 may include a holding part insertion hole 211 to which a holding part 161 of the moving basket 100 (described in more detail below) is selectively inserted.

The holding part insertion hole 211 may be recessed from or defined through an inner surface of the first lifting/lowering space 215. Furthermore, the holding part insertion hole 211 may be configured as multiple holding part insertion holes 211 that are spaced vertically apart from each other.

The moving basket 100 may be fixed at different heights depending on the height of each of the holding part insertion holes 211 to which the holding part 161 is inserted.

Hereinafter, an example structure of the moving basket will be described in detail with reference to the accompanying drawings.

Figure 8:
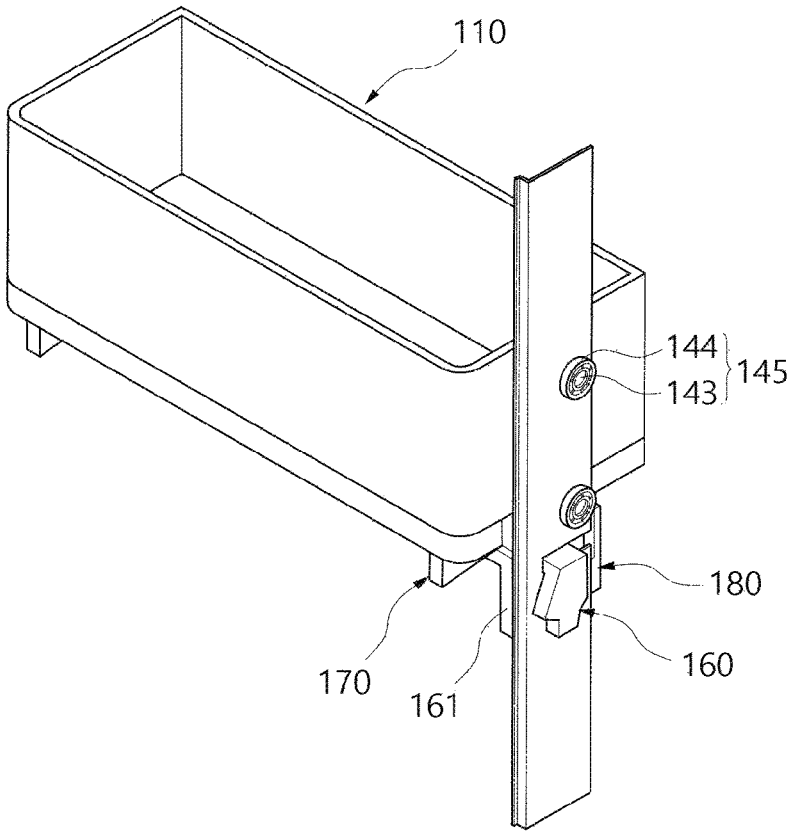
FIG. 8 is a perspective view of the moving basket.
Figure 9:
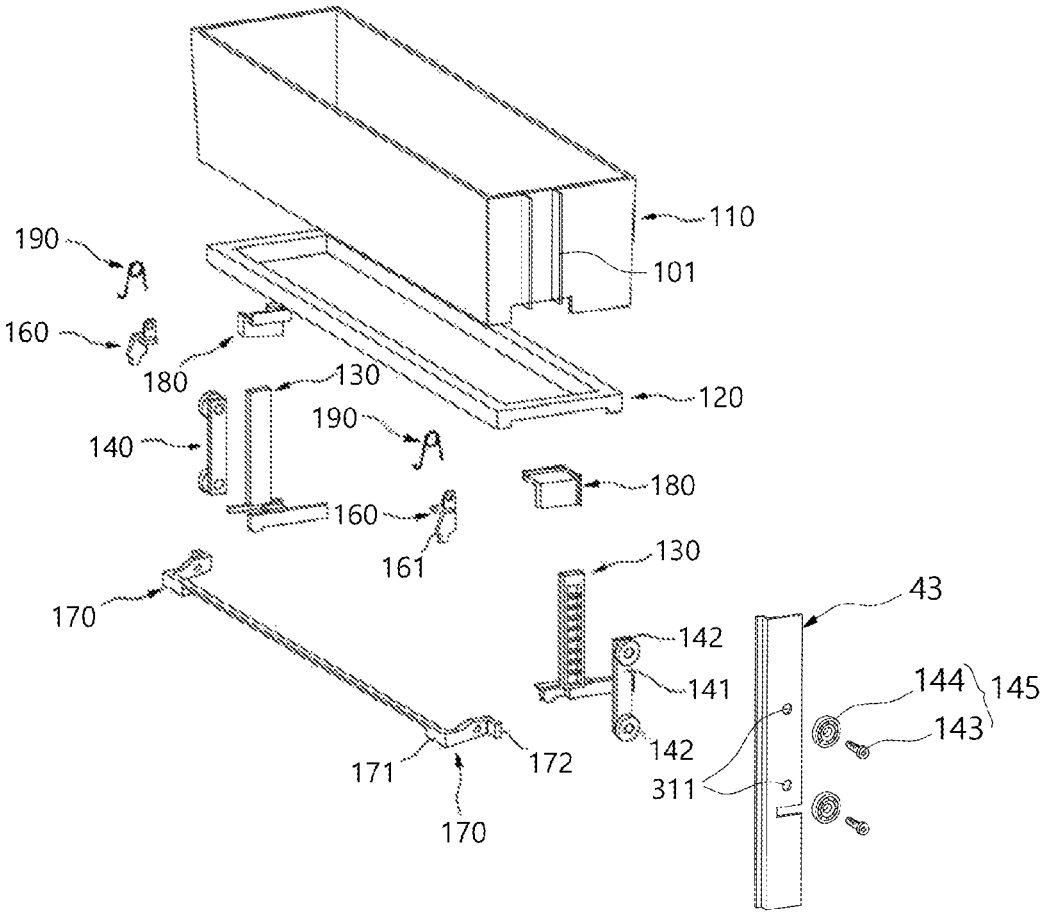
FIG. 9 is an exploded perspective view of the moving basket.
Figure 10:
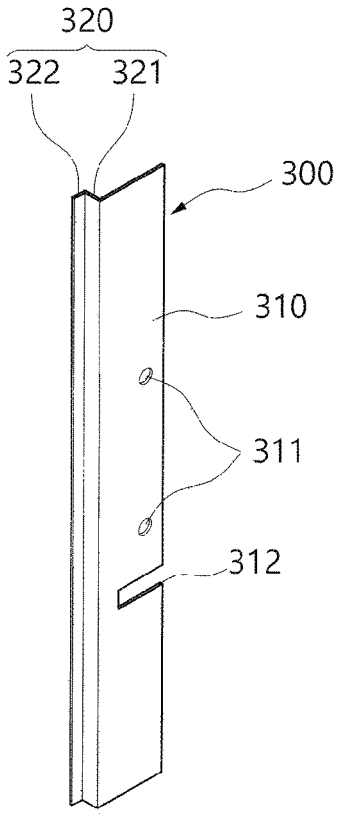
FIG. 10 is a perspective view of the cover member.

Referring to FIGS. 8 and 9, the moving basket 100 may include a basket body 110 configured to store food.

For example, the basket body 110 may generally have a shape of a box having an open upper surface. The basket body 110 may include a lower surface having a plate shape on which food is seated, and surrounding surfaces extending upward from the edges of the lower surface.

The moving basket 100 may include a moving frame 120 that mounts and supports the basket body 110.

The moving frame 120 may have a shape of a frame corresponding to the shape of the lower surface of the basket body 110, and, for example, may be configured in a shape of a rectangular ring having an open center. Alternatively, the moving frame 120 may be configured in a shape of a rectangular plate.

A seating member 101 may be provided at the opposite side surfaces of the basket body 110 and configured to receive an extending frame 130 (described in more detail below).

A recessed space may be defined at the lower surface of the basket body 110 to receive the moving frame 120. Accordingly, the moving frame 120 is inserted to and mounted in the space defined in the lower surface of the basket body 110, so the basket body 110 may be fixed to the moving frame 120.

The moving frame 120 may be a component that substantially supports the load of the moving basket 100. The extending frame 130 may be coupled to each of the left and right opposite sides of the moving frame 120.

In some implementations, a fixing frame 141 may be coupled to the extending frame 130 to couple the roller member 145 (described in more detail below) to the extending frame 130. A fastening member receiving part 142 may be installed in the fixing frame 141 to fasten a rotation center fastening shaft 143 thereto when the roller 144 is coupled to the fixing frame 141.

The roller member 145 may be mounted to the rail member 200 so that the roller member 145 lifts and lowers. Accordingly, the moving frame 120 may be mounted to the rail member 200 so that the moving frame 120 can lift and lower.

In some implementations, the moving frame 120 and the basket body 110 may be configured not to be separated from each other, but to be integral to each other. In other implementations, the moving frame 120 and the basket body 110 are configured to be separate from each other.

The basket body 110 may include a plastic material, and in this case, may be vulnerable to bending loads. In some implementations, a strength of the moving basket 100 can be increased by allowing the basket body 110 to be separate from the moving frame 120 and including a material having a relatively high strength. For example, the moving frame 120 may include a metal material or an aluminum material.

The extending frame 130 may be integral to the moving frame 120. In other implementations, the extending frame 130 may be provided as a separate component, and coupled to the moving frame 120. The extending frame 130 may include a metal material.

The roller member 145 may be provided at the left and right opposite sides of the moving frame 120. The roller member 145 may be fixed to the fixing frame 141 that is coupled to the extending frame 130 fixed to the side surface of the moving frame 120. In this case, in the roller member 145, the roller 144 may be coupled to the fixing frame 141 by the rotation center fastening shaft 143 to be provided integrally to the moving frame 120 so as to be lifted and lowered therewith.

The extending frame 130 may extend upward at a side of the moving frame 120, and may vertically extend along the side surface of the basket body 110.

Accordingly, the left and right side surfaces of the basket body 110 may be supported by the extending frame 130 so that the basket body 110 can be more securely fixed thereto.

The fixing frame 141 may be configured in a plate shape corresponding to the side surface of the extending frame 130. In some implementations, the fixing frame 141 may be configured to be integral to the extending frame 130. In other implementations, the fixing frame 141 and the extending frame 130 may be configured to be separate from each other, and may be coupled to each other.

The fastening member receiving part 142 may protrude at the side surface of the fixing frame 141 in a lateral direction thereof. The fastening member receiving part 142 may have a structure into which the rotation center fastening shaft 143 is inserted so as to fix the roller 144 to the fixing frame 141.

The roller member 145 may include the rotation center fastening shaft 143 protruding from the fixing frame 141 in a lateral direction thereof, and the roller 144 coupled to the rotation center fastening shaft 143 and inserted to the basket guide part 210 of the rail member 200.

The rotation center fastening shaft 143 may function as a rotating shaft on which the roller 144 is rotated, and to fix the roller 144 to the fixing frame 141.

The roller member 145 protrudes from the side surface of the fixing frame 141 in the lateral direction thereof, so the roller 144 can pass through the insertion hole 62 and be inserted to the basket guide part 210 of the rail member 200.

Multiple roller members 145 may be provided on the fixing frame 141 that are spaced vertically apart from each other. Accordingly, the vertical movement of the moving basket 100 can be more efficiently performed by the multiple rollers 144.

The rotation center fastening shaft 143 may be configured to have a left and right width that is smaller than the left and right width of the insertion hole 62 so as to pass through the insertion hole 62. Furthermore, the rotation center fastening shaft 143 may be configured to have a left and right width that is smaller than the left and right widths of the second lifting/lowering space 225 and the first lifting/lowering space 215 so that the rotation center fastening shaft 143 passes through a second lifting/lowering space 225 and is inserted into the first lifting/lowering space 215.

In alternative implementations, the rotation center fastening shaft 143 may not be inserted to the insertion hole 62, and a side of the roller 144 may pass through the insertion hole 62, and be coupled to the rotation center fastening shaft 143. For example, the roller 144 may have a shaft coupling portion extending vertically from a center thereof, and the shaft coupling portion may pass through the insertion hole 62 and be coupled to the rotation center fastening shaft 143.

The roller 144 may be configured to have an outer diameter that corresponds to the left and right width of the first lifting/lowering space 215, and may be held in the first lifting/lowering space 215.

In some implementations, when the roller 144 is coupled to the fixing frame 141 by the rotation center fastening shaft 143, the cover member 300 may be coupled between the roller 144 and the fixing frame 141. For example, after the cover member 300 contacts the fixing frame 141, the roller 144 is attached to an outer side of the cover member 300. Next, the roller 144 can be coupled to the cover member 300 and the fixing frame 141 by using the rotation center fastening shaft 143.

Accordingly, the cover member 300 is fixed to the moving basket 100 by the roller member 145, and thus can vertically move together with the moving basket 100. In detail, the cover member 300 is coupled to the moving frame 120 together with the roller member 145, and thus can vertically move together with the moving basket 100.

The cover member 300 may have a hole 311 so that the rotation center fastening shaft 143 is efficiently coupled to the fastening member receiving part 142 of the fixing frame 141.

The diameter of the hole 311 is preferably smaller than the diameter of the roller 144. Furthermore, to securely fix the cover member 300, the diameter of the hole 311 is preferably smaller than the diameter of the rotation center fastening shaft 143.

In some implementations, the roller member 145 may include a fixing device that is selectively fixed to the rail member 200, and fixes the moving basket 100 to a height desired by a user.

The fixing device may be mounted to the extending frame 130. For example, the fixing device may be mounted to a lower portion of the extending frame 130 under a guide member 140. Alternatively, the fixing device may be mounted to the moving frame 120.

The fixing device may include a lever 160 that is selectively fixed to the rail member 200 by being rotated.

The lever 160 may be provided by being rotatably coupled to the lower side of the extending frame 130. The lever 160 may protrude laterally from the side of the extending frame 130 and may be inserted into the rail member 200.

The holding part 161 may be provided at a side of the lever 160. The holding part may be selectively held in the rail member 200 during the rotation of the lever 160. The holding part 161 may be provided at a position that is spaced apart from the rotation shaft of the lever 160.

In some implementations, the fixing device may include a manipulation member 170 that can be manipulated by a user. The user can release the fixing device that is fixed to the rail member 200 by manipulating the manipulation member 170 so that the moving basket 100 can be lifted and lowered.

For example, a user can rotate the lever 160 by manipulating the manipulation member 170, and thereby allow the lever 160 fixed to the rail member 200 to be released.

The manipulation member 170 may be provided by being rotatably coupled to the lower side of the extending frame 130. The manipulation member 170 may have a manipulation part 171 that can be manipulated by a user.

The manipulation part 171 may be located at the front of the rotation shaft of the manipulation member 170 relative thereto, and may be located to be adjacent to the front surface of the moving basket 100 thereunder. Accordingly, a user can easily approach the manipulation part 171 while the sub door 50 is open.

In some implementations, a pair of manipulation members 170 is located at the left and right opposite sides of the moving frame 120 and may be connected to each other to be operated in cooperation with each other so that the pair of manipulation members 170 is operated together.

Accordingly, the pair of manipulation members 170 that is located at the left and right opposite sides of the moving frame 120 is operated together when a user manipulates any one of the manipulation members 170, so that the fixing devices at the left and right opposite sides are operated together.

For example, the manipulation part 171 may be provided so as not to protrude forward beyond the front surface of the basket body 110, so that the manipulation part 171 can be prevented from being exposed to the outside.

A protrusion 172 may be provided in the manipulation member 170 to rotate the lever 160. The protrusion 172 may be located behind the rotation shaft of the manipulation member 170 relative thereto. Furthermore, the lever 160 is located behind the rotation shaft of the manipulation member 170, and may contact the protrusion 172.

The protrusion 172 contacts the lever 160, and during the rotation of the manipulation member 170, presses the lever 160 so that the lever 160 is rotated. Accordingly, the lever 160 is rotated based on the rotation of the manipulation member 170, so the holding part 161 is inserted to and fixed to the holding part insertion hole 211 of the rail member 200, or is removed from the insertion hole 211 so that the fixing is released.

For example, when displacement occurs in the manipulation part 171 by a user's manipulation, displacement of the lever 160 occurs. In this case, the moving basket 100 is fixed to the rail member 200, or is vertically moved along the rail member 200 by such rotation of the lever 160.

In some implementations, a spring 190 may be provided between the manipulation member 170 and the lever 160. The spring 190 can be elastically transformed while the lever 160 is rotated in a direction of a first side thereof. Furthermore, when the lever 160 is rotated in a direction of a second side thereof, the spring 190 can provide an elastic force to the lever 160 so that the lever 160 is restored to an initial position thereof.

For example, the initial state of the lever 160 may be a state in which the lever 160 is rotated so that the holding part 161 of the lever 160 is inserted to the holding part insertion hole 211 of the rail member 200, and the moving basket 100 is at a state held thereby.

In addition, the spring 190 is elastically deformed by rotating the manipulation member 170, and the lever 160 is rotated in the direction of the first side thereof, so the holding part 161 can be removed from the holding part insertion hole 211. Accordingly, the fixing of the moving basket 100 can be released.

The spring 190 may be a torsion spring that can be coupled to the rotation shaft of the lever 160. Furthermore, when the lever 160 is rotated in the direction of the first side thereof, the spring 190 may be provided to contact the first side of the lever 160 and to be elastically deformed.

In some implementations, the fixing device may include a cover 180 that receives the rotation shaft of the manipulation member 170, the rotation shaft of the lever 160, and the rotation shaft of the spring 190. The cover 180 may be mounted to the moving frame 120 or the extending frame 130 by a fastening member such as a screw.

The rotating components can be protected by the cover 180. Furthermore, the rotating components can be prevented from interfering with the outside, and the components can be prevented from malfunctioning due to introduction of foreign matter thereto.

Hereinafter, an example structure of the cover member will be described in detail with reference to the accompanying drawings.

Referring to FIGS. 10-13, the cover member 300 is supported by the roller member 145 of the moving basket 100, and is lifted and lowered together with the moving basket 100 during the lifting and lowering of the moving basket 100. Specifically, the cover member 300 is coupled to the roller 144 when the roller 144 of the roller member 145 is coupled to the moving frame 120, and thus can be lifted and lowered together with the moving basket 100.

The cover member 300 may include a cover member body 310 configured to have a transverse width that is equal to or greater than the transverse width of the insertion hole 62 so as to cover the insertion hole 62.

The cover member body 310 may be configured as a plate shape that has a transverse width equal to or greater than the transverse width of the insertion hole 62.

The cover member body 310 may be configured to be vertically longer than the insertion hole 62 so that the cover member body 310 covers the insertion hole 62 while being lifted and lowered during the lifting and lowering of the moving basket 100.

Accordingly, when the moving basket 100 is maximally lifted or lowered, the insertion hole 62 can be covered by the cover member 300. Hereinafter, the length of the cover member 300 will be described further in detail with reference to FIG. 14.

In some implementations, a plurality of holes 311 and a cut part 312 may be defined at the cover member body 310.

The rotation center fastening shaft 143 can pass through the holes 311 such that the rotation center fastening shaft 143 is efficiently coupled to the fixing frame 141.

The lever 160 can pass through the cut part 312. For example, the cut part 312 may have a pathway through which the lever 160 extends to the first lifting/lowering space 215.

Accordingly, the lever 160 passes through the cut part 312, and may extend to the inside of the first lifting/lowering space 215.

In some implementations, the cut part 312 may be configured to correspond to a vertical sectional view of the lever 160 that is located in the second lifting/lowering space 225.

For example, the cut part 312 may have a vertical height corresponding to the vertical height of the lever 160 located in the second lifting/lowering space 225. Where the shape of the section of the lever 160 located in the second lifting/lowering space 225 is not a circular shape, the cut part 312 may be vertically longer than the vertical height of the lever 160 located in the second lifting/lowering space 225 in consideration of the rotation of the lever 160.

The cover member 300 is supported on a side of the moving basket 100 by the roller member 145, and thus can lift and lower together with the moving basket 100 during the lifting and lowering of the moving basket 100.

The roller member 145 may be inserted into the first lifting/lowering space 215 of the rail member 200. For example, the rail member 200 extends vertically, and the first lifting/lowering space 215 may be embodied to receive the roller member 145. Accordingly, the roller 144 may be coupled to the rail member 200 so that the roller 144 is vertically moved in the first lifting/lowering space 215 of the rail member 200.

The rail member 200 and the cover member 300 may be spaced apart by a predetermined interval from each other so that the cover member 300 does not collide with the rail member 200 during the vertical movement of the cover member 300. This is to reduce noise which may result from collision between the cover member 300 and the rail member 200 during the vertical movement of the cover member 300.

In addition, when the cover member 300 is assembled with the moving basket 100, the roller member 145 and the lever 160 may be inserted into the first lifting/lowering space 215 through the upper opening or lower opening of the rail member 200. Furthermore, the cover member 300 may be inserted into the second lifting/lowering space 225.

For example, the first lifting/lowering space 215 and the second lifting/lowering space 225 may be configured to be open downward or upward so that the rail member 200 is assembled with the cover member 300, the roller member 145, and the lever 160.

In some implementations, the rail member 200 assembled with the cover member 300, the roller member 145 and the lever 160 may be assembled with the mounting part 60.

In some implementations, at least one end part of the left and right end parts of the cover member body 310 may include multiple bent parts. For example, a bent part 320 may be provided at at least one end part of the left and right end parts of the cover member body 310.

Since the end part of the cover member body 310 includes a bent portion, the strength of the cover member 300 is increased, so deformation and damage thereof are prevented. Since the deformation of the cover member 300 is prevented, the insertion hole 62 is more effectively covered by the cover member 300.

Figure 11:
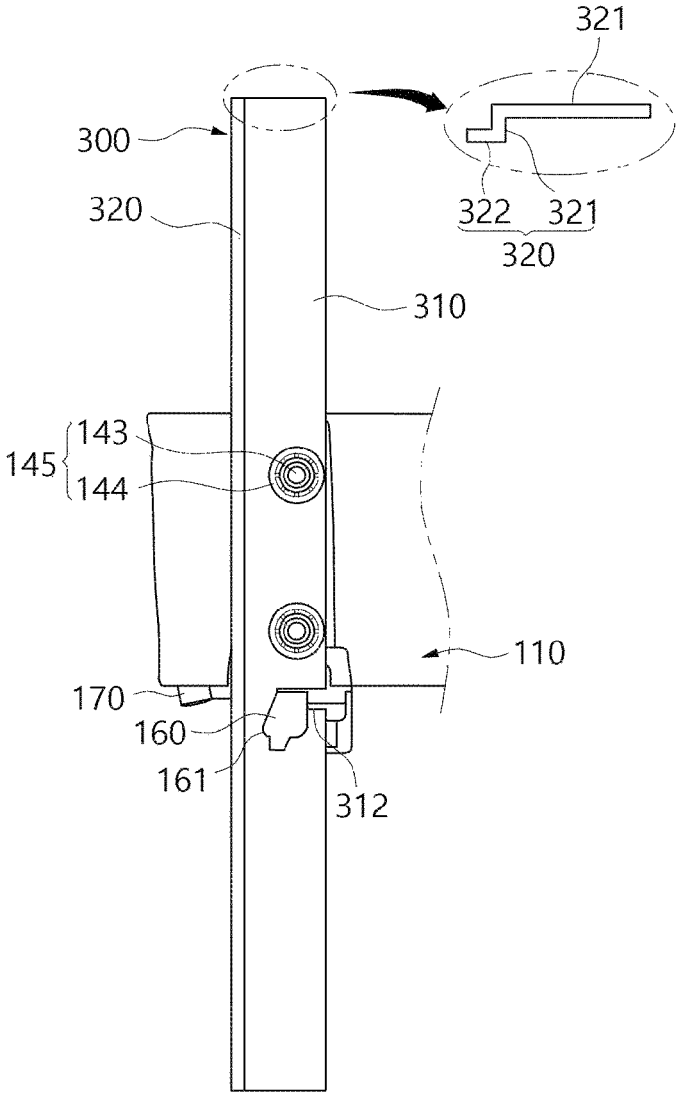
FIG. 11 illustrates the cover member that is coupled to the moving basket.
Figure 12:
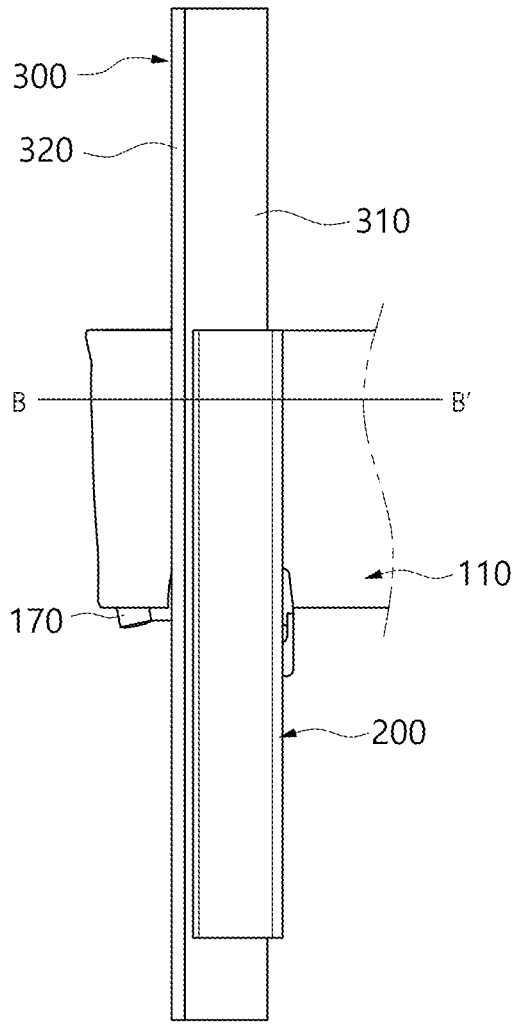
FIG. 12 illustrates the rail member that is coupled to a roller member in FIG. 11.
Figure 13:
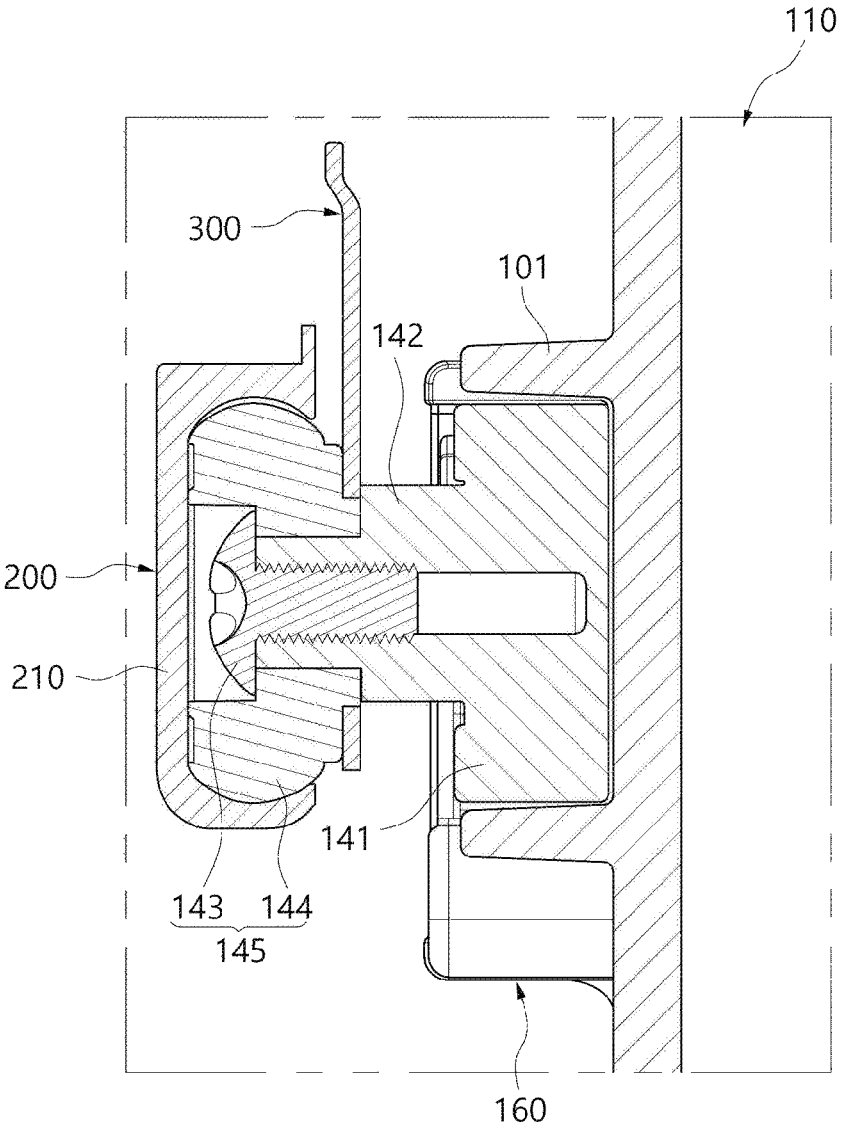
FIG. 13 is a sectional view illustrating that the rail member, the roller member, and the cover member are coupled to the moving basket, taken along line B-B' of FIG. 12.

In some implementations, referring to FIG. 11, the bent part 320 may include a first bent part 321 extending from the cover member body 310, and a second bent part 322 bent outward from the first bent part 321. The bent part 320 that is bent vertically is only illustrative, and other shapes are also possible. For example, the bent part 320 may include a curved shape.

Figure 14:
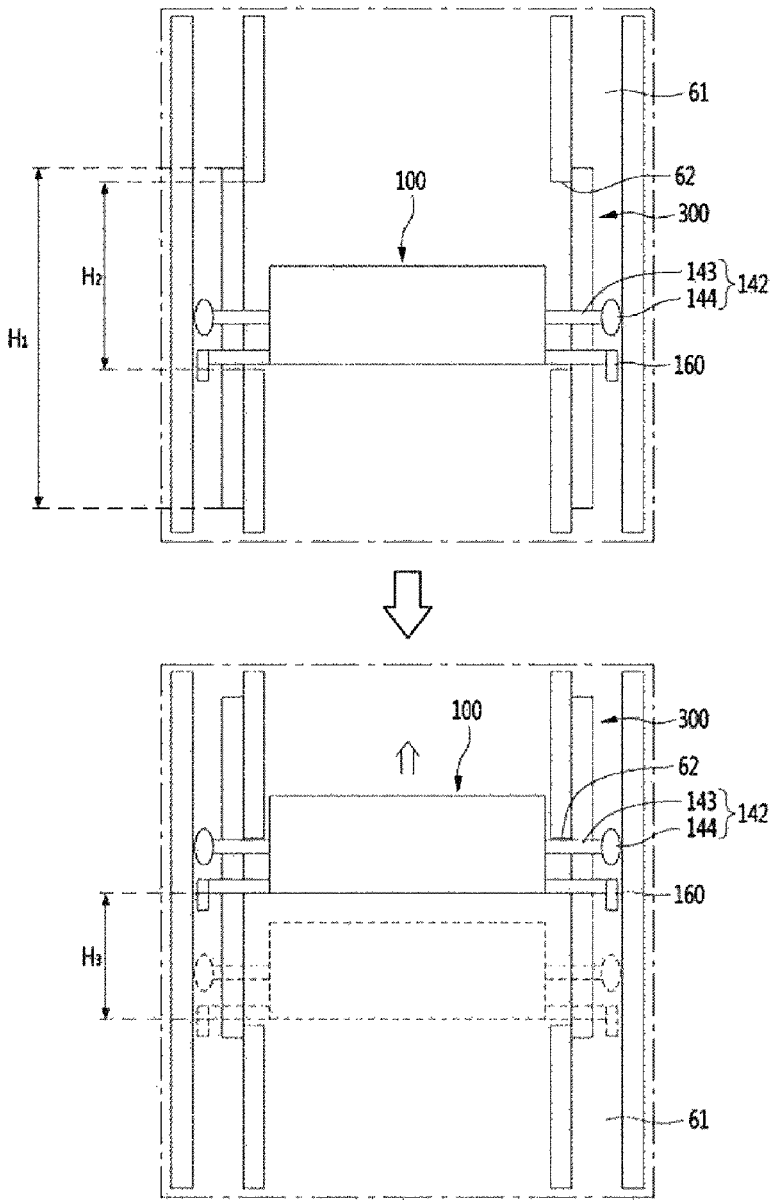
FIG. 14 illustrates an example movement by which the cover member covers an insertion hole during the vertical movement of the moving basket.
Figure 15:
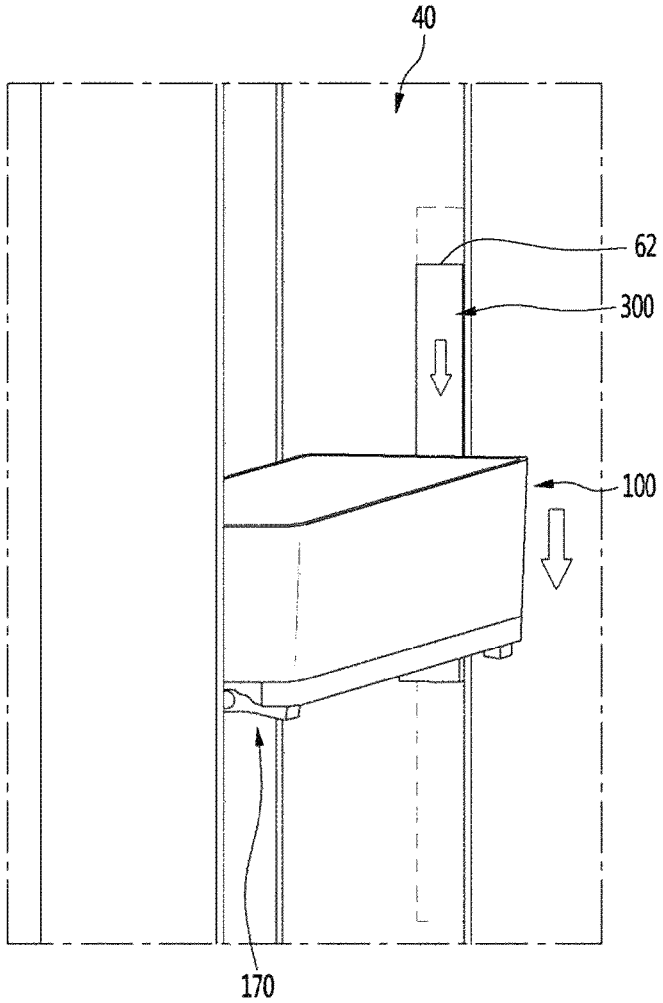
FIG. 15 illustrates the insertion hole that is covered by the cover member during the lowering of the moving basket.
Figure 16:
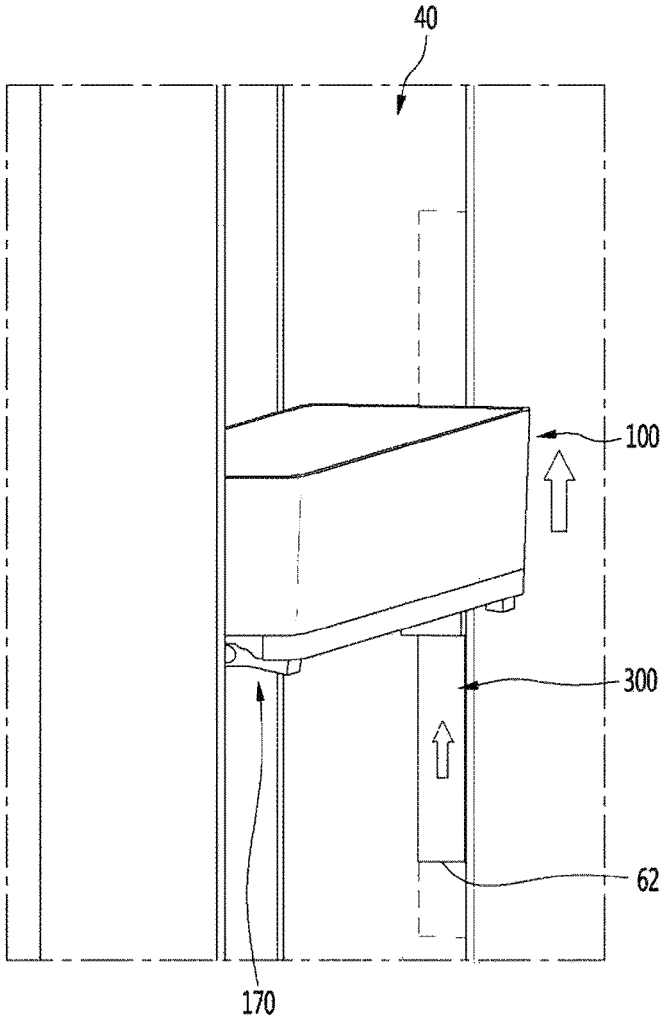
FIG. 16 illustrates that the insertion hole is covered by the cover member during the lifting of the moving basket.

Referring to FIGS. 14-16, the length of the cover member 300 may be at least a length that sums the maximum movable height of the moving basket 100 and the length of the insertion hole 62.

For example, the vertical height H1 of the cover member body 310 covering the insertion hole 62 may be at least the length that adds the maximum movable height H3 of the moving basket 100 to the vertical height H2 of the insertion hole 62. For example, the vertical length H1 of the cover member body 310 the vertical length H2 of the insertion hole 62+the maximum movable height H3 of the moving basket 100.

When the moving basket 100 is maximally lifted, the upper end of the cover member body 310 may be located at a position higher than the upper end of the insertion hole 62 by at least the maximum lowerable height of the moving basket 100. When the moving basket 100 is maximally lowered, the lower end of the cover member body 310 may be located at a position lower than the lower end of the insertion hole 62 by at least the maximum liftable height of the moving basket 100.

Accordingly, even when the moving basket 100 is maximally lifted or lowered, the insertion hole 62 can be completely covered by the cover member 300.

Referring to FIGS. 14 and 15, a user can release the state in which the moving basket 100 is fixed to the rail member 200 by manipulating the manipulation member 170.

In some implementations, when the state of the moving basket 100 fixed to the rail member 200 is released, the moving basket 100 can be lowered. When the moving basket 100 is lowered, the cover member 300 coupled to the roller member 145 of the moving basket 100 is lowered therewith. When the cover member 300 is lowered, the upper portion of the cover member 300 lying inside the main door 40 is located to correspond to the insertion hole 62 and can cover the insertion hole 62. For example, the upper portion of the cover member 300 located at a position higher than the upper end of the insertion hole 62 is moved downward, and covers the insertion hole 62.

In some implementations, after a user releases the state of the moving basket 100 fixed to the rail member 200 by manipulating the manipulation member 170, the moving basket 100 can be lifted. When the moving basket 100 is lifted, the cover member 300 coupled to the roller member 145 of the moving basket 100 is lifted together therewith. When the cover member 300 is lifted, the lower portion of the cover member 300 lying inside the main door 40 is located to correspond to the insertion hole 62, and can cover the insertion hole 62. For example, the lower portion of the cover member 300 located at a position lower than the lower end of the insertion hole 62 is moved upward, and covers the insertion hole 62.

Accordingly, during the lifting and lowering of the moving basket 100, the trajectory of the lifting and lowering of the moving basket 100 is covered by the cover member 300, whereby appearance of the refrigerator becomes neat, the introduction of foreign matter through the insertion hole 62 is prevented, and a portion of a user's body is prevented from being caught in the insertion hole 62.

Although implementations of the present disclosure has been described above with reference to the accompanying drawings, the present disclosure is not limited to the above implementations and may be manufactured in various different configurations. Those skilled in the art to which the present disclosure pertains may understand that the present disclosure can be implemented in other specific configurations without changing the technical spirit or essential characteristics of the present disclosure. Therefore, it should be understood that the above-described implementations are illustrative in all respects and not restrictive.

What is claimed is:

1. A refrigerator comprising:

a cabinet;

a door that is configured to open and close at least a portion of the cabinet and that includes a storage room;

a first rail receiving part that is disposed at a first side of the storage room and that defines a first rail space;

a first rail member that is received in the first rail space of the first rail receiving part;

a basket disposed in the storage room of the door;

a first roller member that is disposed at a first side of the basket and that is coupled to the first rail member so that the basket moves along the first rail member;

a first insertion hole that is open at the first side of the storage room to correspond to the first rail receiving part and that defines a path of the movement of the basket; and a first cover member that is disposed in the first rail receiving part and that is configured to, based on the movement of the basket, move to cover the first insertion hole, wherein the first roller member mounts the first cover member to the basket, and wherein the first cover member has a length that is equal to or greater than a sum of a maximum movement length of the basket and a length of the insertion hole, so that the insertion hole is covered by the first cover member based on the basket being at a maximum extended position along the first rail member.

2. The refrigerator of claim 1, wherein the first rail member comprises:

a first movement space that permits the first roller member to move, and a first basket guide part that guides the movement of the first roller member.

3. The refrigerator of claim 2, wherein the first basket guide part covers the first roller member, and wherein the first roller member that is inserted into the first movement space is configured to move along the first basket guide part.

4. The refrigerator of claim 2, wherein the basket comprises:

a basket body configured to receive an item, and a moving frame that is mounted to the basket body, wherein the first roller member is disposed at a first side of the moving frame.

5. The refrigerator of claim 4, wherein the first roller member comprises:

a roller configured to move along the first basket guide part in the first movement space, and a rotation center fastening shaft that fastens the roller to the basket, wherein the roller is configured to move along the first basket guide part and rotates relative to the rotation center fastening shaft.

6. The refrigerator of claim 5, wherein the first cover member defines a hole at a position that corresponds to a position of the roller, and wherein the rotation center fastening shaft is inserted into a center of the roller, extends through the hole of the first cover member, and is fastened to the basket.

7. The refrigerator of claim 6, wherein a diameter of the hole is smaller than a diameter of the rotation center fastening shaft.

8. The refrigerator of claim 1, wherein the first cover member has a width equal to or greater than a width of the first insertion hole.

9. The refrigerator of claim 1, wherein, based on the basket being maximally moved in a first direction, a first end of the first cover member is located at a position lower than a first end of the insertion hole by at least the maximum movement length of the basket, and wherein, based on the basket being maximally moved in a second direction opposite to the first direction, a second end of the first cover member is located at a position higher than a second end of the insertion hole by at least the maximum movement length of the basket, the second end of the first cover member being opposite to the first end of the first cover member, and the second end of the insertion hole being opposite to the first end of the insertion hole.

10. The refrigerator of claim 1, wherein the first rail member and the first cover member are spaced apart by a predetermined distance from each other to restrict the first cover member from interfering with the first rail member during the movement of the first cover member.

11. The refrigerator of claim 1, wherein at least one of opposite ends of the first cover member includes a plurality of angled portions.

12. The refrigerator of claim 1, wherein the door comprises:

a main door that is coupled rotatably to the cabinet, and that is configured to, based on the rotation of the main door, open and close the cabinet, the main door including an open part that is open to a storage space of the cabinet, and a sub door that is mounted rotatably to the main door, and that is configured to open and close the open part of the main door, wherein the open part of the main door defines the storage room of the door.

13. The refrigerator of claim 1, wherein the refrigerator extends along a longitudinal direction, and wherein the basket is configured to move along the longitudinal direction.

14. The refrigerator of claim 1, further comprising:

a second rail receiving part that is disposed at a second side of the storage room and that defines a second rail space;

a second rail member that is received in the second rail space of the second rail receiving part;

a second roller member that is disposed at a second side of the basket and that is coupled to the second rail member so that the basket moves along the second rail member;

a second insertion hole that is open at the second side of the storage room to correspond to the second rail receiving part and that defines a path of the movement of the basket; and a second cover member that is disposed in the second rail receiving part and that is configured to, based on the movement of the basket, move to cover the second insertion hole, wherein the second roller member mounts the second cover member to the basket.

15. The refrigerator of claim 14, wherein the second side of the storage room is opposite to the first side of the storage room, and wherein the second side of the basket is opposite to the first side of the basket.

16. The refrigerator of claim 14, wherein the second rail member comprises:

a second movement space that permits the second roller member to move, and a second basket guide part that is configured to guide the movement of the second roller member.

17. The refrigerator of claim 16, wherein the second basket guide part covers the second roller member, wherein the second roller member that is inserted into the second movement space is configured to move along the second basket guide part.

18. The refrigerator of claim 16, wherein the second roller member is disposed at a second side of the moving frame that is opposite to the first side of the moving frame.

19. The refrigerator of claim 18, wherein the second roller member comprises:

a roller configured to move along the second basket guide part in the second movement space, and a rotation center fastening shaft that fastens the roller to the basket, wherein the roller is configured to move along the second basket guide part and rotate relative to the rotation center fastening shaft.

* * * * *